US007304616B1

(12) United States Patent
Chen et al.

(10) Patent No.: US 7,304,616 B1
(45) Date of Patent: Dec. 4, 2007

(54) ANTENNA STRUCTURE OF MOBILE PHONE

(75) Inventors: Hung Jen Chen, Tu-Cheng (TW); Jia Hung Su, Tu-Cheng (TW); Jhao Huei Yu, Tu-Cheng (TW); Yu Yuan Wu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/510,810

(22) Filed: Aug. 28, 2006

(51) Int. Cl.
*H01Q 1/48* (2006.01)
*H01Q 1/38* (2006.01)

(52) U.S. Cl. ..... 343/846; 343/700 MS

(58) Field of Classification Search ..... 343/700 MS, 343/702, 846
See application file for complete search history.

(56) References Cited

U.S. PATENT DOCUMENTS 6,724,348 B2 * 4/2004 Fang ..... 343/702
2005/0088351 A1 * 4/2005 Tai et al. ..... 343/702
2007/0109196 A1 * 5/2007 Tang et al. ..... 343/700 MS

* cited by examiner

*Primary Examiner*—Shih-Chao Chen
(74) *Attorney, Agent, or Firm*—Rosenberg, Klein & Lee

(57) ABSTRACT

An antenna structure includes an antenna portion having an antenna defining a feeding point and a grounding point, and a grounding portion electrically connecting with the grounding point of the antenna. The grounding portion defines a basic board. The basic board is bent upwardly from edges thereof to form a first extending portion. The first extending portion is bent inwardly from a top edge thereof to form a second extending portion approximately paralleling with the basic board. Through the first and second extending portions, the area of the grounding portion is extended. And the electric field is widely distributed all over the whole grounding portion including the basic board and the first and second extending portions to decrease the SAR of the antenna.

5 Claims, 4 Drawing Sheets

ANTENNA STRUCTURE OF MOBILE PHONE

BACKGROUND OF THE INVENTION

1. Field of the Invention

The present invention relates to an antenna structure of mobile phone, and particularly to an antenna structure with lower specific absorption rate (SAR).

2. The Related Art

As the development of modern mobile communication industry, mobile phones are designed more and more smaller with beautiful appearance and have better broadcasting and receiving capability. In this case, the SAR of the mobile phone becomes high and thus unacceptable by most applied regulations.

As shown in FIG. 4, a conventional antenna structure 100 includes an antenna portion 110 and a grounding portion 120. The antenna portion 110 located on the front portion of the grounding portion 120, includes a printed circuit board (PCB) 111 and an antenna 112 printed on top surface of the PCB 111. The grounding portion 120 is merely a sheet metal placed on a housing 130 of a mobile phone. The antenna 112 defines a feeding point 113 and a grounding point 114. The grounding point 114 electrically connects with the grounding portion 120 through the PCB 111.

However, because the grounding portion 120 of the conventional antenna structure 100 is in a plane type formation, the size of the grounding portion 120 is restricted by the length and width of the housing 130 of the mobile phone. Since the electric field of the conventional antenna structure 100 is focused within the limited grounding portion 120, the SAR of the conventional antenna structure 100 is therefore increased.

SUMMARY OF THE INVENTION

Accordingly, an object of the present invention is to provide an antenna structure with improved mechanism to reduce the SAR value. The antenna structure includes an antenna portion having an antenna defining a feeding point and a grounding point, and a grounding portion electrically connecting with the grounding point of the antenna. The grounding portion of the antenna defines a basic board. The basic board is bent upwardly from edges thereof to form a first extending portion. The first extending portion is further bent inwardly from a top margin thereof to form a second extending portion approximately paralleling with the basic board. Through the first and second extending portions, the area of the grounding portion is extended. And the electric field is widely distributed all over the whole grounding portion including the basic board and the first and second extending portions. This means that the electric field in unit area is decreased. So, the SAR value of the whole antenna structure is reduced.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
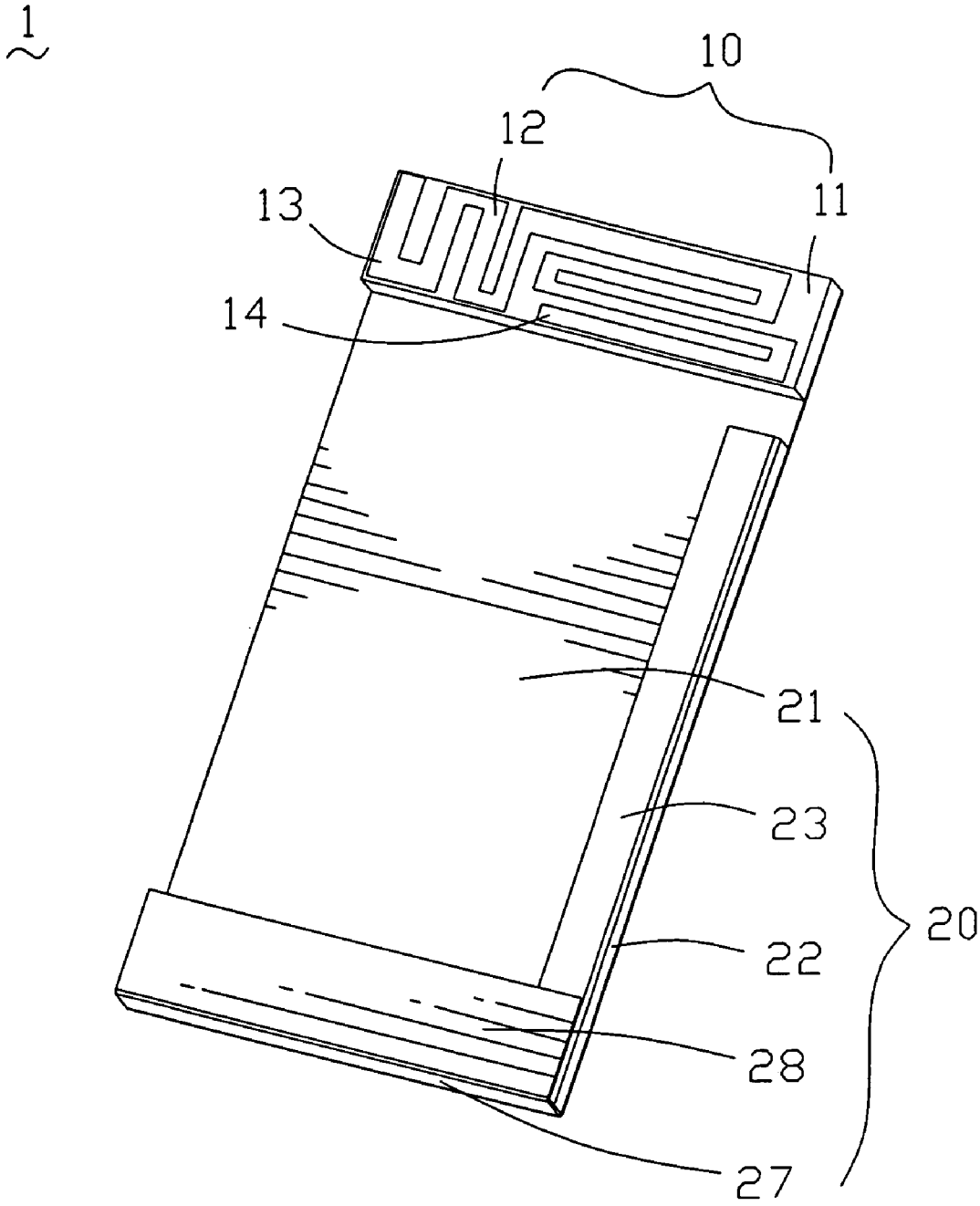
FIG. 1 is a perspective view of an antenna structure according to the first embodiment of the present invention.
Figure 2:
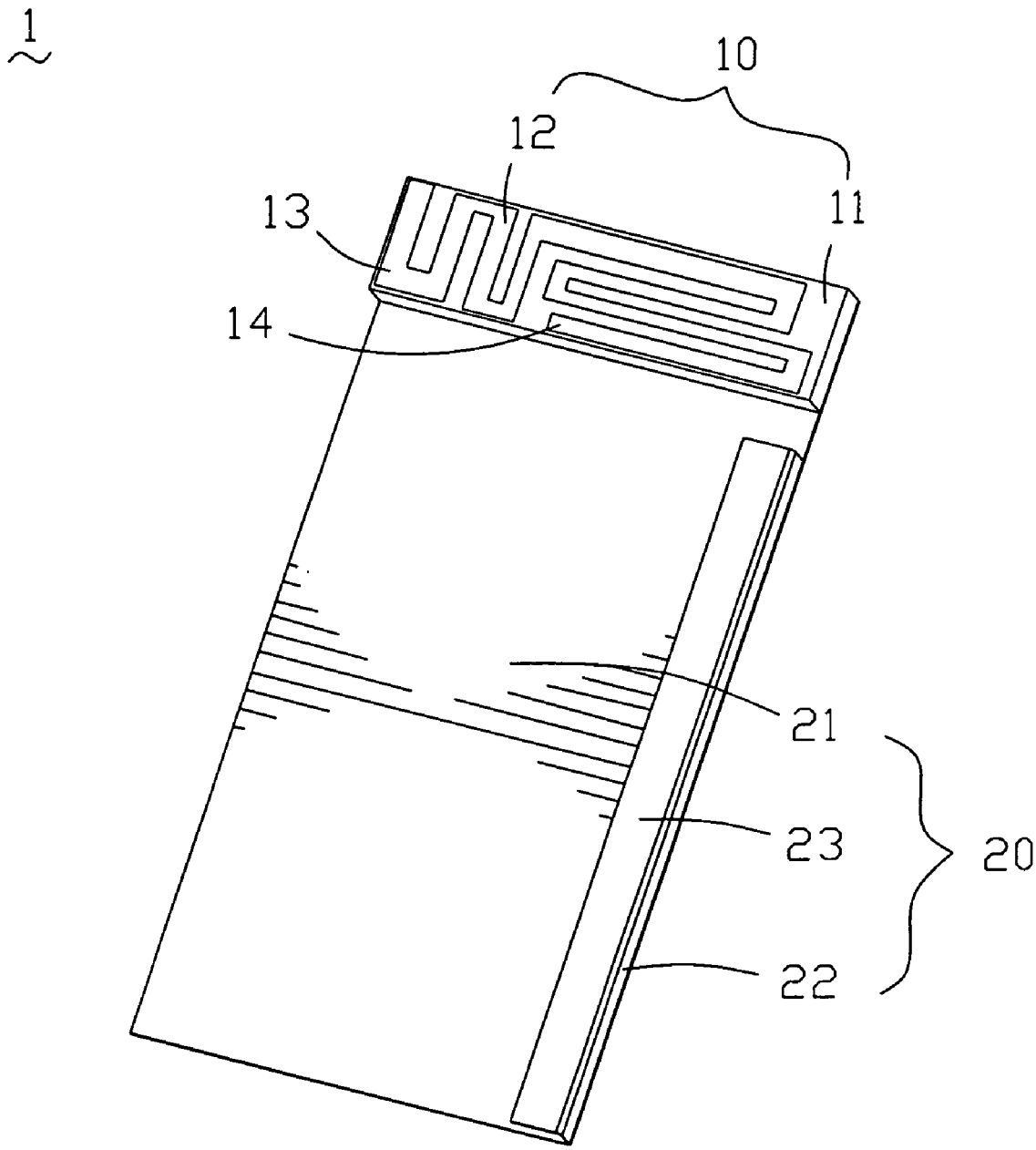
FIG. 2 is a perspective view of an antenna structure according to the second embodiment of the present invention.
Figure 3:
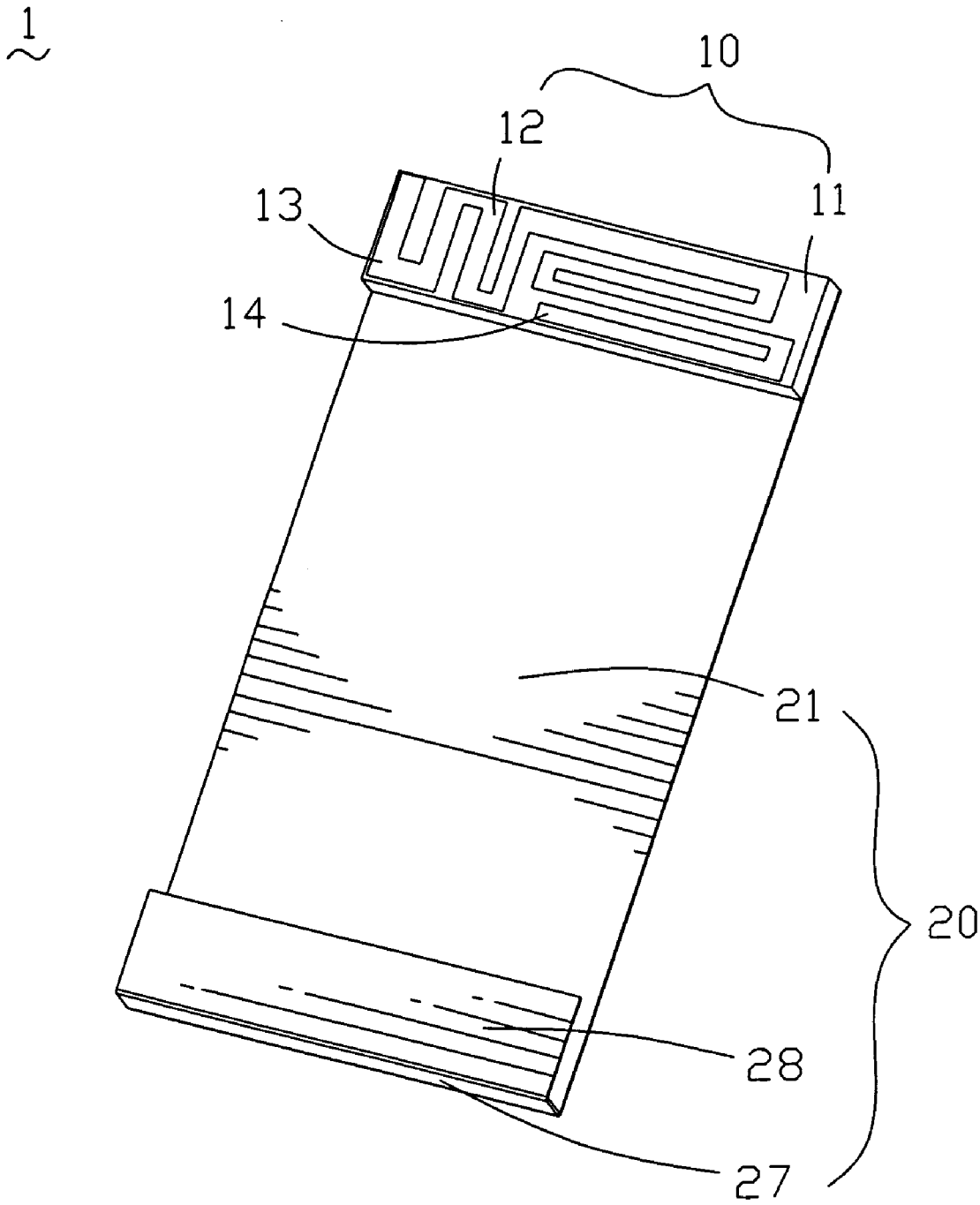
FIG. 3 is a perspective view of an antenna structure according to the third embodiment of the present invention.
Figure 4:
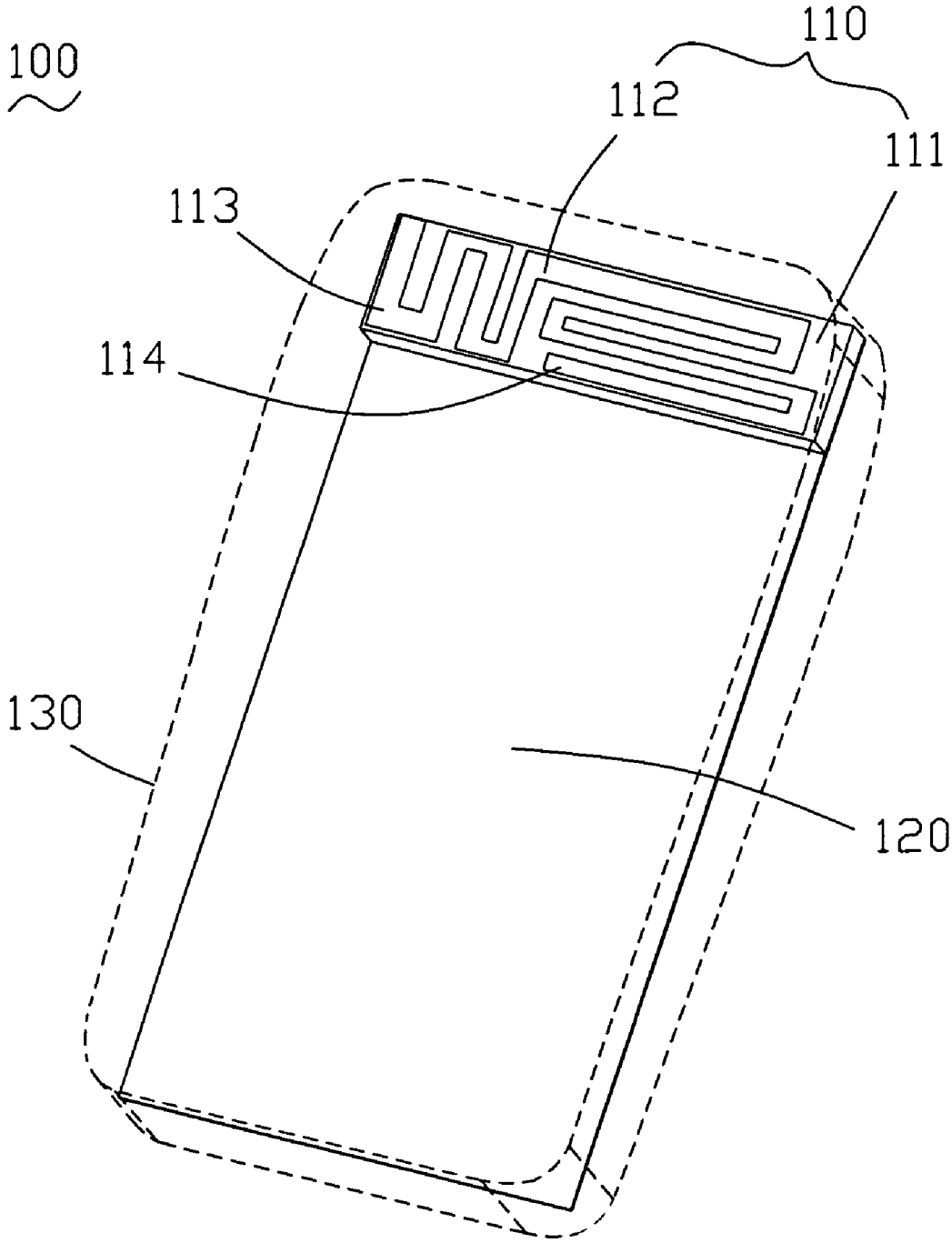
FIG. 4 (Prior Art)
FIG. 4 is a perspective view of a conventional antenna structure assembled in a housing of a mobile phone.

The antenna structure according to preferred embodiments of the present invention is illustrated in FIGS. 1-3 and provides the functional arrangement and formation to reduce the SAR of the antenna.

Referring now to FIGS. 1-3, the antenna structure 1 includes an antenna portion 10 and a grounding portion 20 of metal material electrically connecting with the antenna portion 10. The antenna portion 10 is located on a front of the grounding portion 20. And the grounding portion 20 stretches backwardly from a bottom of the antenna portion 10. Alternatively, the antenna portion 10 may be positioned at any other convenient location in a housing (not shown) of a mobile phone (also not shown), such as on the back or side of the grounding portion 20.

The antenna portion 10 includes a printed circuit board (PCB) 11 and an antenna 12 printed on top of the PCB 11. The antenna 12 defines a feeding point 13 and a grounding point 14. The grounding point 14 electrically connects with the grounding portion 20 downwardly through the PCB 11. In this embodiment the antenna 12 is designed to be fixed inside the mobile phone. However, the antenna 12 is not only limited to be printed on the PCB 11 or located inside the mobile phone. And the antenna 12 also may be other type or positioned at any other convenient location inside or outside the mobile phone on condition that the antenna 12 of the antenna portion 10 electrically connects with the grounding portion 20.

The grounding portion 20 defines a basic board 21 of sheet metal shape stretching backwardly from a bottom of the antenna portion 10. The basic board 21 matches with the shape of a housing of the mobile phone and is of rectangle shape. The basic board 21 is bent upwardly from edges to form first extending portions 22, 27. This makes the grounding portion 20 looks like a box without cover, and the first extending portions 22, 27 just as walls of said box. And then, the first extending portions 22, 27 further extend inwardly from top edges thereof to form second extending portions 23, 28 to extend the area of the grounding portion 20.

Having briefly described the antenna structure 1, as well as its more significant features and advantages, the various embodiments of the antenna structure 1 according to the present invention will now be described in detail.

Referring to FIG. 1, the grounding portion 20 according to the first embodiment of the present invention may be provided with a basic board 21 being bent upwardly from the right and back edges to form first extending portions 22, 27. The first extending portions 22, 27 are further bent inwardly from the top edge thereof to form second extending portions 23, 28 approximately paralleling with the basic board 21.

As shown in FIG. 2, the grounding portion 20 according to the second embodiment of the present invention may be provided with a basic board 21 being bent upwardly from the right edge thereof to form the first extending portion 22. Then, the first extending portion 22 is further bent left from the top edge to form the second extending portion 23 approximately paralleling with the basic board 21.

Referring to FIG. 3, the grounding portion 20 according to the third embodiment of the present invention may be provided with a basic board 21 being bent upwardly from the back edge to form the first extending portion 27. Then, the first extending portion 27 is further bent forwardly from the top edge to form the second extending portion 28 approximately paralleling with the basic board 21.

Accordingly, the present invention should not be regarded as limited to the particular configuration of the first and second extending portions 22,27 and 23,28 that are shown and described herein, and may be bent from any other convenient portions of the basic board 21 and be stretched to any other convenient directions, as would be obvious to persons having ordinary skill in the art after having become familiar with the teaching of the present invention.

As described above, the antenna structure 1 through the first and second extending portions 22,27 and 23,28 being bent from the edge of the basic board 21 to increase the area of the grounding portion 20. This means that the electric field is distributed within the whole grounding portion and the amount of electric field in unit area is decreased. So, the SAR value of the antenna structure 1 is reduced.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An antenna structure, comprising:

an antenna portion having a feeding point and a grounding point; and a grounding portion stretching backwardly to form a bottom of said antenna portion, and electrically connecting with said grounding point of said antenna portion;

wherein said grounding portion comprises a basic board of sheet metal with edges being bent upwardly to form a first extending portion of wall shape; the first extending portion is bent inwardly from a top edge thereof to form a second extending portion approximately paralleling with said basic board.

2. The antenna structure as claimed in clam 1, further comprising a PCB on which said antenna is printed, and said grounding point of said antenna electrically connecting with said grounding portion via said PCB.

3. The antenna structure as claimed in clam 1, wherein said first extending portion is bent upwardly from a side of said basic board.

4. The antenna structure as claimed in clam 1, wherein said first extending portion is bent upwardly from the back of said basic board.

5. An antenna structure, comprising:

an antenna portion having a feeding point and a grounding point; and a grounding portion stretching backwardly to form a bottom of said antenna portion, and electrically connecting with said grounding point of said antenna portion, wherein said grounding portion further comprises a basic board of sheet metal with side and back edges bent upwardly to form a first extending portion of wall shape; said first extending portion is further bent inwardly from a top edge thereof to form a second extending portion approximately paralleling with said basic board.

* * * * *